US007798834B2

(12) United States Patent
Wu

(10) Patent No.: US 7,798,834 B2
(45) Date of Patent: Sep. 21, 2010

(54) PANEL-MOUNT CABLE ASSEMBLY WITH QUICK-LOCK

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,008

(22) Filed: Apr. 27, 2009

(65) Prior Publication Data

US 2010/0035476 A1 Feb. 11, 2010

Related U.S. Application Data

(63) Continuation of application No. 12/221,692, filed on Aug. 5, 2008, now Pat. No. 7,607,930.

(51) Int. Cl.
*H01R 13/74* (2006.01)

(52) U.S. Cl. ..... 439/247; 439/565

(58) Field of Classification Search ..... 439/247, 439/563, 565

See application file for complete search history.

(56) References Cited

U.S. PATENT DOCUMENTS 3,179,367 A * 4/1965 Rapata ..... 248/239
3,486,158 A * 12/1969 Soltysik et al. ..... 439/92
4,827,609 A * 5/1989 Kawecki ..... 29/832
4,842,529 A * 6/1989 Frantz et al. ..... 439/95
4,874,336 A * 10/1989 Marsh ..... 439/607.37
5,066,237 A * 11/1991 Shiley ..... 439/82
6,688,831 B2 * 2/2004 Antonucci et al. ..... 411/553
6,824,419 B1 * 11/2004 Wu ..... 439/378
6,896,556 B1 5/2005 Wu
6,997,658 B2 * 2/2006 Fly ..... 411/107
7,658,643 B2 * 2/2010 Tuerschmann et al. ..... 439/564
2008/0145186 A1 * 6/2008 Jin ..... 411/480
2010/0035476 A1 * 2/2010 Wu ..... 439/638

* cited by examiner

*Primary Examiner*—James Harvey
(74) *Attorney, Agent, or Firm*—Wei Te Chung; Andrew C. Cheng; Ming Chieh Chang

(57) ABSTRACT

A cable assembly (100) includes a first insulated housing (1) having at least a first mounting slot (101) and a corresponding second mounting slot (102) defined therein, a fastening member for fastening the first insulated housing and a panel together, the fastening member including a latching member (5) accommodated in the first mounting slot and anchoring plate (6) accommodated in the second mounting slot, the screw having a base portion and a shrinkable post portion integrated with the base portion, the anchoring plate defining a first through hole and a second through hole communicated with the first through hole, the post portion being larger than the second through hole and smaller than the first through hole; and the post portion of the latching member inserted into the first mounting hole and locked into the second through hole of the anchoring plate.

20 Claims, 10 Drawing Sheets

PANEL-MOUNT CABLE ASSEMBLY WITH QUICK-LOCK

CROSS-REFERENCE TO RELATED APPLICATION

This application is a continuation of U.S. patent application Ser. No. 12/221,692, filed on Aug. 5, 2008 now U.S. Pat. No. 7,607,930 and entitled "CABLE CONNECTOR ASSEMBLY HAVING IMPROVED FIXING MEMBER", which has the same assignee as the present invention.

BACKGROUND OF THE INVENTION

1. Field of the Invention

The present invention relates to a cable assembly, and more particularly to a cable assembly having quick-lock means for fastening itself to a panel.

2. Description of Related Art

In recent days, an electrical connector known as a Serial Advanced Technology Attachment (Serial ATA) connector, according to the newly developed Serial ATA interface standard, is developed to be generally used for connecting storage peripheral devices such as hard disk drives with a mother printed circuit panel so as to achieve signal or power transmission therebetween. The Serial ATA connector has many advantages such as low voltage requirement, low pin count and high speed transmission.

A cable assembly is typically described in U.S. Pat. No. 6,896,556 issued to Wu on May 24, 2005. The cable assembly comprises a first housing extending in a lengthwise direction and a number of first and second contacts received in the first housing in a lateral direction perpendicular to the lengthwise direction, a cable including a number of conductors electrically connecting with the first contacts, a second housing back to back assembled to the first housing and a number of third contacts electrically connecting with the first contacts, a panel, a pair of screws inserting through the first housing and the panel, and a pair of screw caps engaging with the screws. The screw and the screw cap respectively have mutual cooperated screw thread. The panel could be fixed onto the first housing via the engagement between the screws and the screw caps.

When the screw and the screw cap are assemble together, screwdriver or other tool is needed to operate them, furthermore, the screw thread of the screw and the screw thread of the screw cap may be abrased, and the engagement between the screw and the screw cap is not reliable enough for fastening the panel onto the first housing.

Hence, a cable assembly having an improved fastening member is highly desired.

SUMMARY OF THE INVENTION

Accordingly, an object of the present invention is to provide a cable assembly having an improved fastening member.

In order to achieve the object set forth, a cable assembly in accordance with the present invention adapted for mounting to a panel defining at least a hole therein. The cable assembly comprises a first insulated housing having a base portion and a mating portion extending forwardly from the base portion, at least a first mounting slot and a corresponding second mounting slot defined in the base portion, said first mounting slot perpendicular to and in communication with the second mounting slot; a plurality of terminals received in the first insulated housing; a fastening member mounted to the base portion of the first insulated housing for fastening the first insulated housing to the panel, the fastening member including a latching member accommodated in the first mounting slot and an anchoring plate accommodated in the second mounting slot, the latching member having a base portion and a shrinkable post portion integrated with the base portion, the anchoring plate defining a first through hole and a second through hole communicated with the first through hole, the post portion being larger than the second through hole and smaller than the first through hole; and the post portion of the latching member inserted into the first mounting hole and locked into the second through hole of the anchoring plate, and the anchoring plate being moveable to align the post portion of the latching member with the first through hole of the anchoring plate to release the latching member from the anchoring plate.

Other objects, advantages and novel features of the invention will become more apparent from the following detailed description when taken in conjunction with the accompanying drawings.

DETAILED DESCRIPTION OF THE PREFERRED EMBODIMENT

Figure 1:
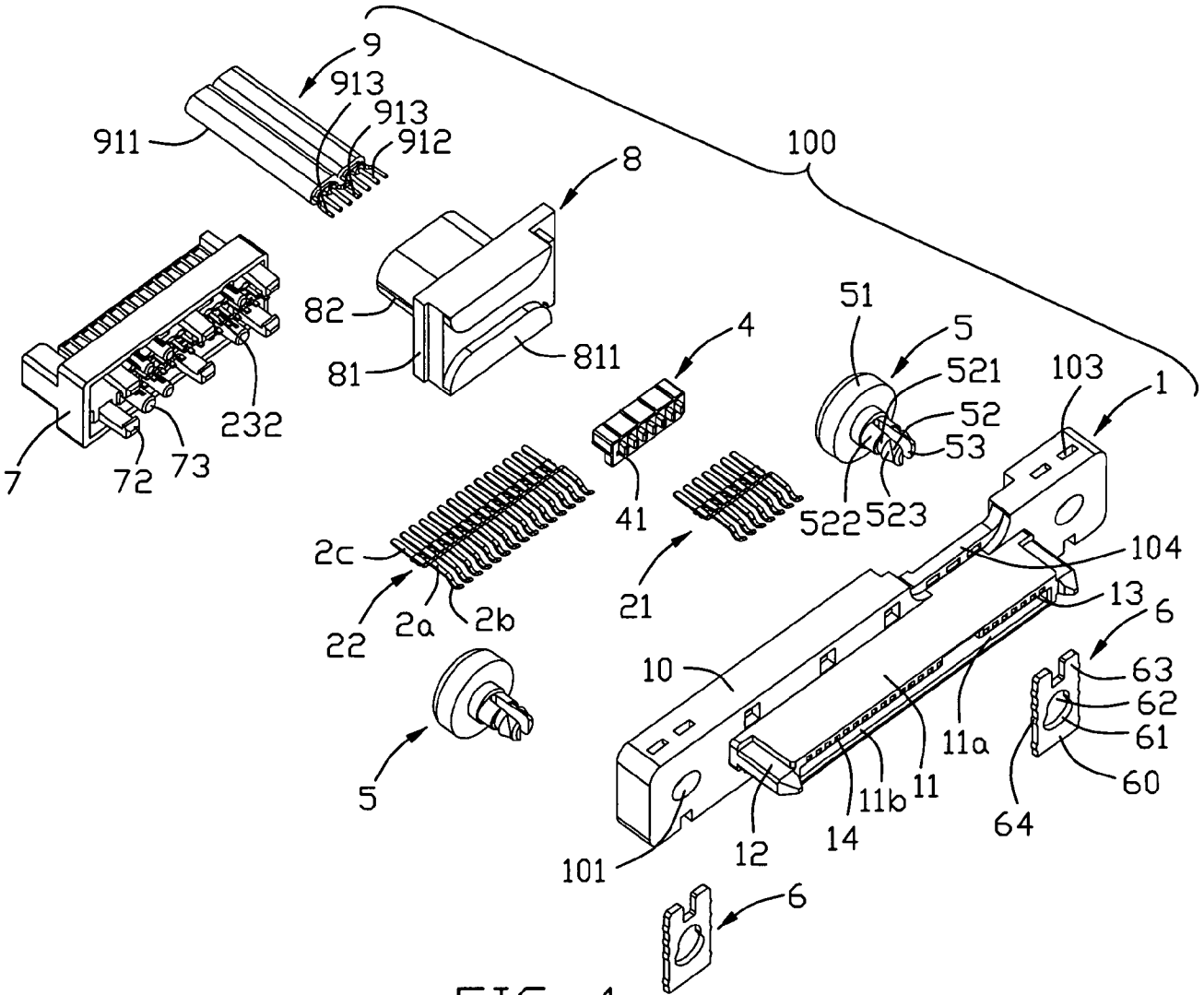
FIG. 1 is an exploded, perspective view of a cable assembly in accordance with the present invention.
Figure 2:
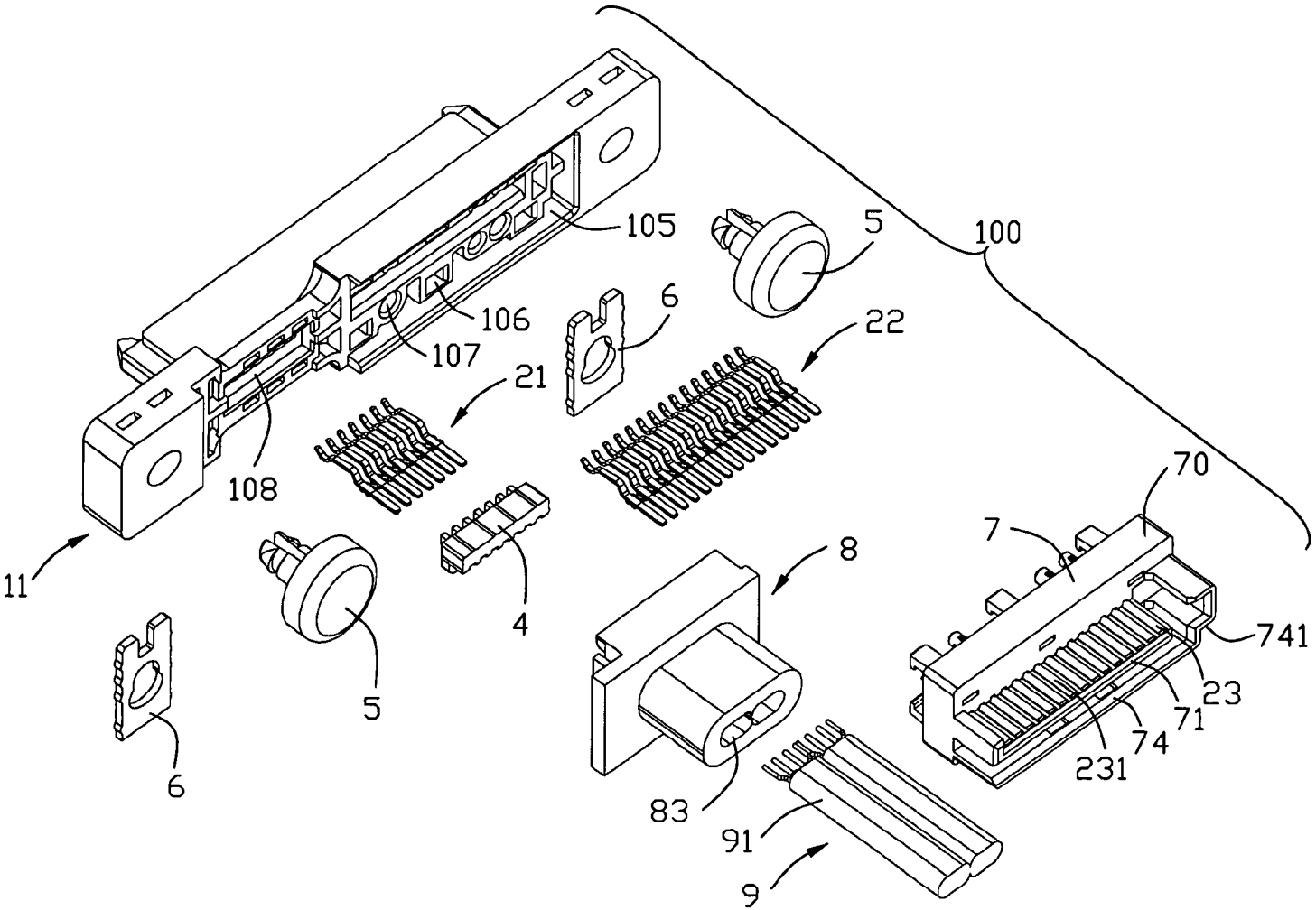
FIG. 2 is a view similar to FIG. 1, but taken from another aspect.
Figure 3:
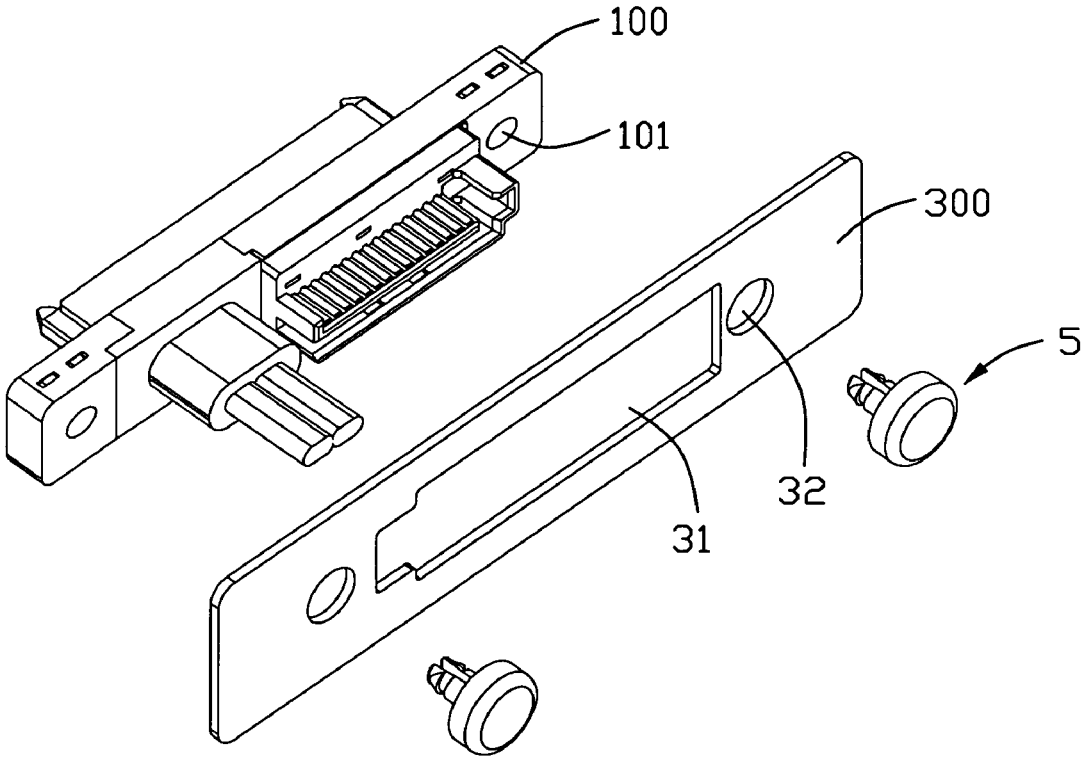
FIG. 3 shows the cable assembly separated from a panel.
Figure 4:
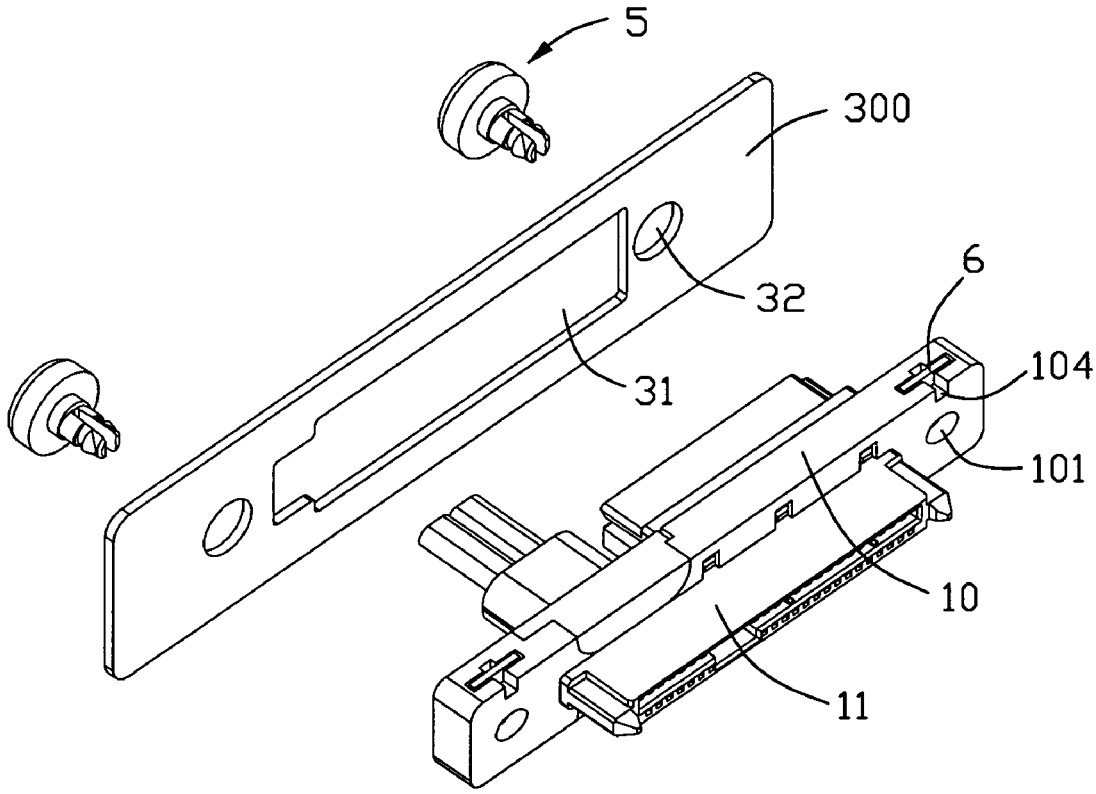
FIG. 4 is a view similar to FIG. 3, but taken from another aspect.
Figure 5:
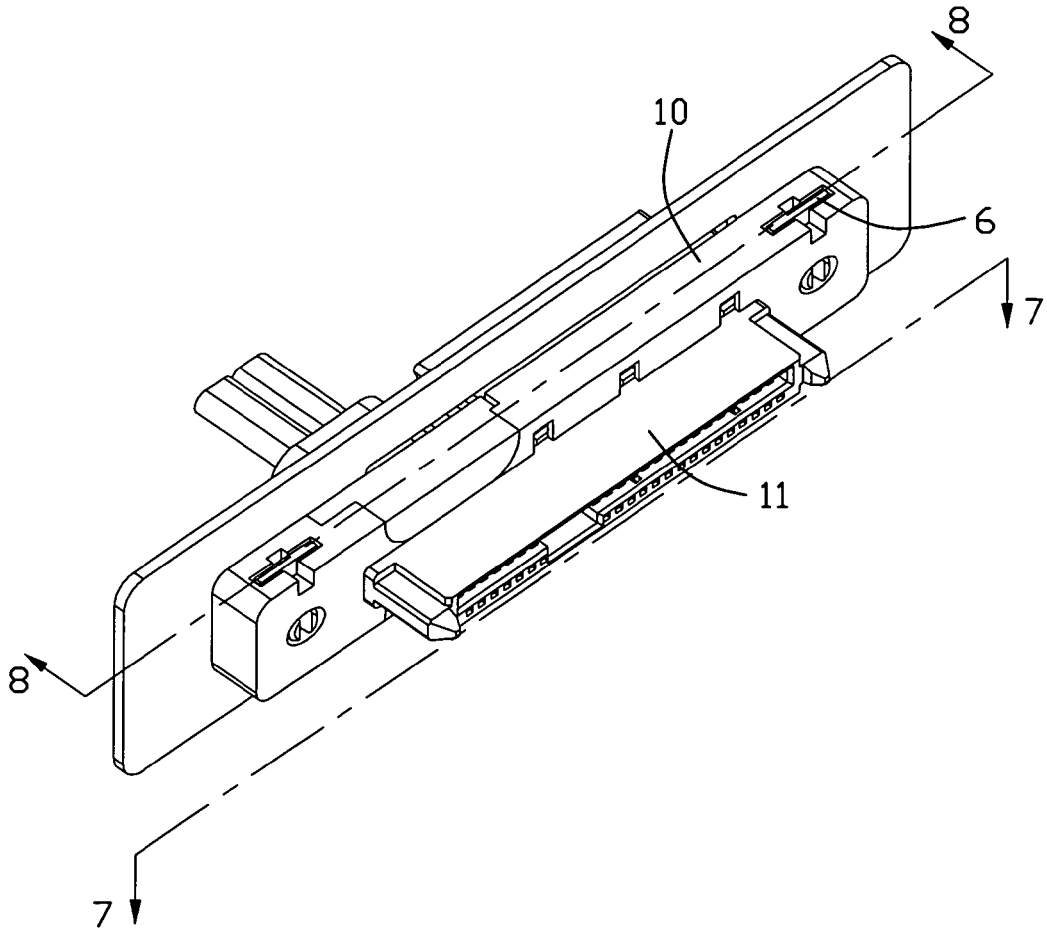
FIG. 5 shows the cable assembly being mounted to the panel.
Figure 6:
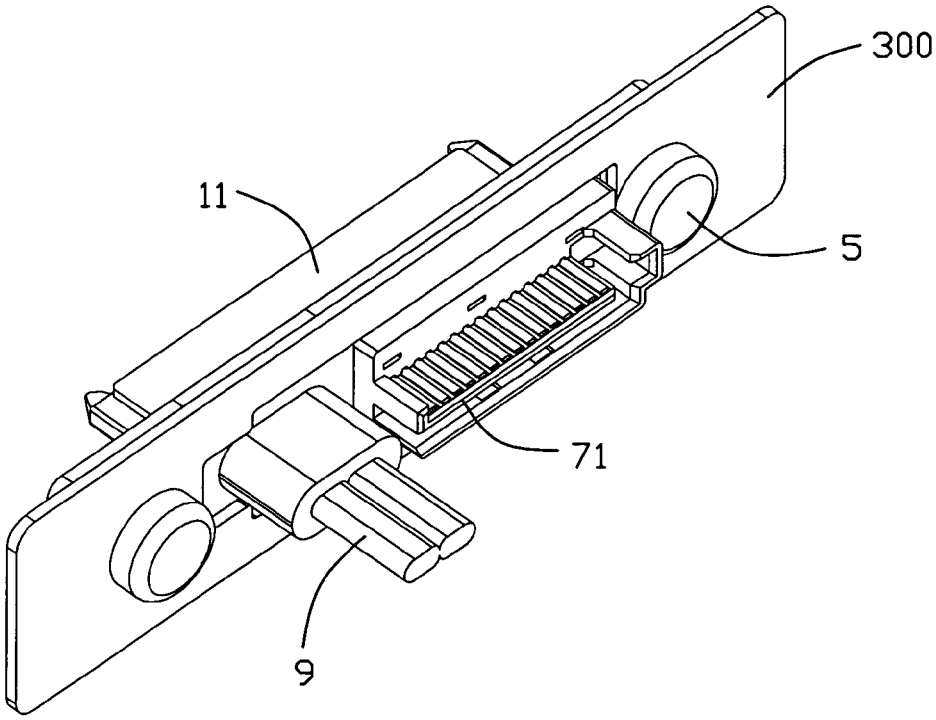
FIG. 6 is a view similar to FIG. 5, but taken from another aspect.
Figure 7:
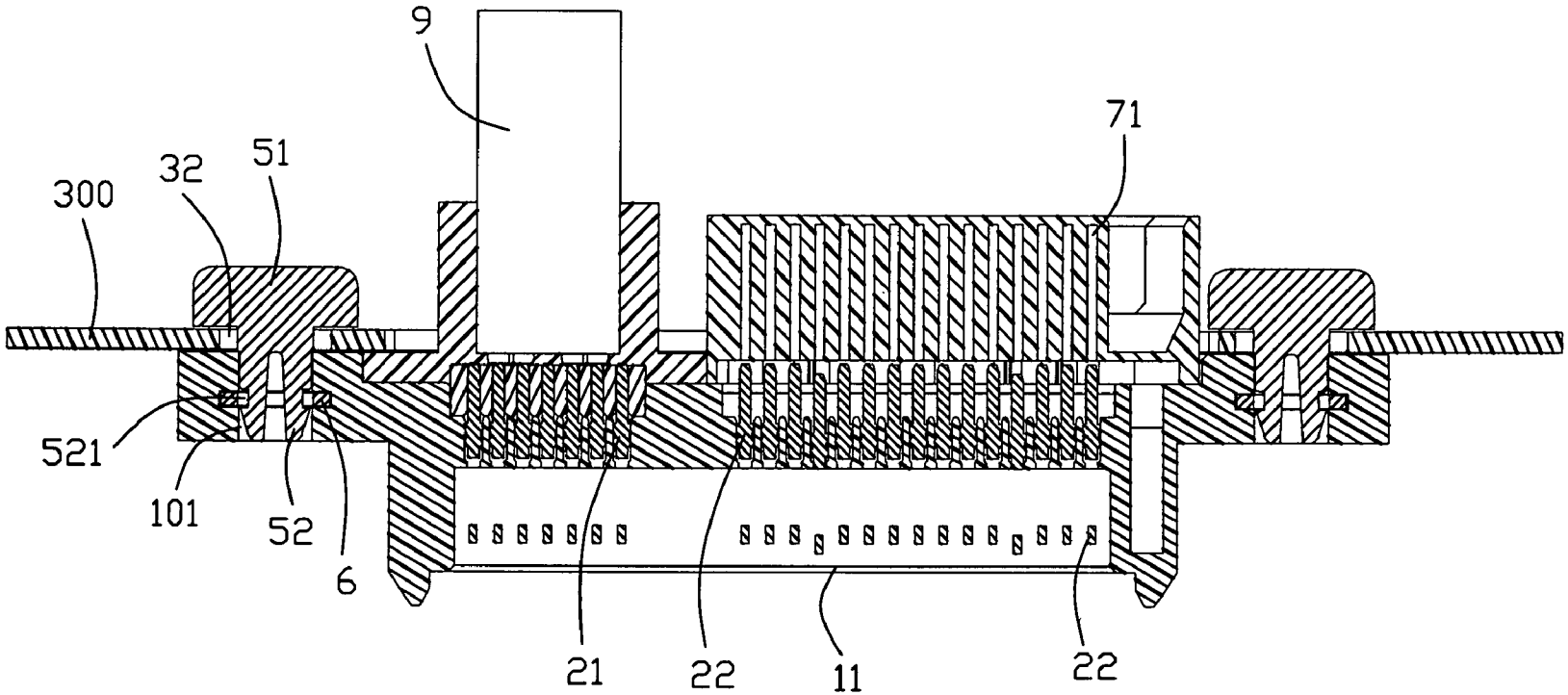
FIG. 7 is a cross-sectional view taken along line 7-7 of FIG. 5.
Figure 8:
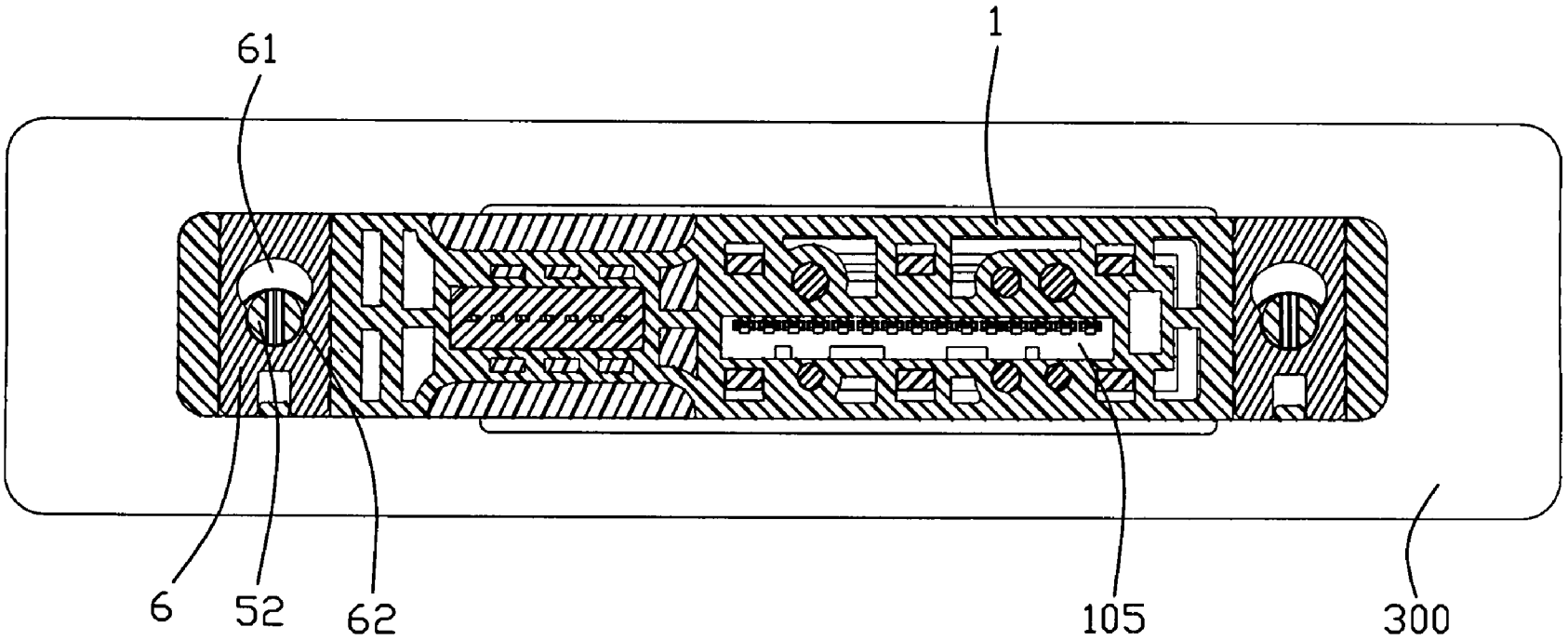
FIG. 8 is a cross-sectional view taken along line 8-8 of FIG. 5.

Reference will now be made in detail to the preferred embodiment of the present invention.

Referring to FIGS. 1-8, a cable assembly 100 adapted for mating with a panel 300 in accordance with the present invention comprises a first insulated housing 1, a plurality of terminals 21, 22, 23, a retention portion 4 retained in the first insulated housing 1, a second insulated housing 7 assembled to the first insulated housing 1, a cable 9 connected to the first insulated housing 1 via a connecting portion 8, a pair of latching member 5 and a pair of anchoring plate 6 engaging with the latching member 5. The latching member 5 and the anchoring plate 6 are cooperated as a fastening/fixing member.

The first insulated housing 1 has an elongated base portion 10 and a mating portion 11 extending forwardly from a front face of the base portion 10. The mating portion 11 has a pair of protruding posts 12 disposed at opposite ends thereof for guiding the cable assembly 1 to mate with a complementary connector (not shown) along a mating direction.

The mating portion 11 includes a first and a second mating ports 11*a*, 11*b* arranged in a side-by-side manner. The first mating port 11*a* has a lengthwise dimension smaller than that of the second mating port 11*b*. The base portion 10 defines a cavity 105 extending therethrough to communicate with the second mating port 11*b*, and a plurality of circular holes 107 and rectangular slots 106 located at upper and lower sides of the cavity 105. The base portion 10 defines a receiving space 108 corresponding to the first mating port 11*a* in a rear face thereof. The first insulated housing 1 defines a plurality of first passageways 13 communicating with the first mating port 11*a* and the receiving space 108, and a plurality of second passageways 14 communicating with the second mating port 11*b* and the cavity 105.

A pair of first mounting slots 101 are defined in lateral sections of the base portion 10 and arranged at opposite sides of the mating portion 11. The first mounting holes 101 extend along a first direction (front-to-back direction). A pair of second mounting slots 102 are also respectively defined in the lateral sections of the base portion 10 and extending along a second direction (vertical direction). The second mounting slots 102 are arranged perpendicular to and in communication with the first mounting slots 101, respectively. Two windows 103 are defined in an upper sides of the corresponding lateral section and communicate with each of the second mounting holes 102. A horizontal slot 104 is defined in a lower side of the corresponding lateral section and intersects with the corresponding second mounting slot 102.

The first terminals 11 has four signal terminals and three ground terminals. The second terminals 22 are power terminals. Each first terminal 21 or second terminal 22 includes a contact portion 2*b*, a tail portion 2*c*, and an intermediate portion 2*a* interconnecting the contact portion 2*b* and the tail portion 2*c*. Each third terminal 23 has a flat portion 231 and a Z-shaped engaging portion 232 connected with the flat portion 231.

Each latching member 5 comprises a base portion 51, a post portion 52 having a slit 53 defined therein to divide itself into two deformable parts, which are shrinkable toward an axial line of the post portion 52. The post portion 52 has a platform 522 formed on a peripheral side thereof, a position recess 521 defined in the platform 522. The platform 522 further defines a tapered front end 523.

The anchoring plate 6 comprises a main portion 60, a first through hole 61 defined in a middle segment of the main portion 60, a second through hole 62 defined in an upper segment of the main portion 60 and in communication to the first through hole 61. The first through hole 61 is large than the post portion 52 in a diametrical direction, and the second through hole 62 is smaller than the post portion 52 in the diametrical direction, so that the post portion 52 can be inserted through the first through hole 61 freely, and locked with the second through hole 62. Two stubs 63 are spaced part each other and extend upwardly from a top edge of the main portion 60. A number of barbs 64 are formed on two lateral edges of the main portion 60.

The retention portion 4 has a plurality of third passageways 41 defined therein.

The second insulated housing 7 includes a body portion 70, a tongue portion 71 extending rearwardly from a middle portion of the body portion 70 for mating with a complementary second connector (not shown), and a planar plate 74 extending rearwardly from a lower section of the body portion 70 and parallel to the tongue portion 71. A substantially U-shaped second wall 741 extends rearwardly from a lateral section of the body portion 70 and aligns with the tongue portion 71 along a horizontal direction. The body portion 70 has a plurality of locking beams 72 and posts 73 extend forwardly from a front face thereof.

The connecting portion 8 comprises a base wall 81 and a boot portion 82 protruding rearwardly from a rear face of the base wall 81. The boot portion 82 has a pair of insertion slots 83 extending through the connecting portion 8. The base wall 81 comprises a pair of clasping portions 811 formed at a front side thereof.

The cable 9 comprises a pair of wires 91 each includes an insulative jacket 911, a pair of differential signal conductors 912 and a pair of ground conductors 913 exposed out of the jacket 911 at one end thereof.

The panel 300 defines an opening 31 in a middle portion thereof and a pair of holes 32 at opposite sides of the opening 31.

In assembly of the cable assembly 100, the first terminals 21 are inserted in third passageways 41 of the retention portion 4. The retention portion 4 together with the first terminals 21 are mounted in the receiving space 108 of the first insulated housing 1, with the intermediate portions 2*a* of the first terminals 21 retained in the first passageways 13 and the contact portions 2*b* exposed in the first mating port 11*a*. The second terminals 22 are inserted into the second passageways 14 of the first insulated housing 1 along the mating direction, with the contact portions 2*b* thereof exposed in the second ports 11*b*. Four signal conductors 912 of the cable 9 are respectively soldered with the tail portions 2*c* of the four signal terminals of the first terminals 21. The ground conductors 913 of each wire 91 are soldered with the tail portions 2*c* of the ground terminals of the first terminals 21.

The connecting portion 8 is overmolded with the cable 9 and the first insulated housing 1 after the wires 91 are soldered with the first terminals 21. The pair of clasping portions 811 of the base wall 81 are plunged into the depressions 104.

The second housing 2 is back to back assembled to the first insulated housing 1 with the posts 73 received in the holes 107 of the first insulated housing 1 and the locking beams 72 locking with into the slots 106 to thereby interlocking the first insulated housing 1 with the second insulated housing 7 together. The tail portions 2*c* of the second terminals 22 disposed in the cavity 105 and resiliently contact with the engaging portions 232 of the third terminals 23.

The anchoring plate 61 are respectively mounted to the second mounting slots 102, with the second through holes 62 thereof respectively aligning with the first mounting slots 101. The first insulated housing 1 is mounted to the panel 300, with the second insulated housing 7 and the retention portion 8 together with the cable 9 extending outwardly from the opening 31, and the holes 32 aligned with corresponding first mounting slots 101. The post portion 52 of each latching member 5 is inserted through the hole 32 of the panel 300 and into the corresponding first mounting holes 101. Then the post portion 52 is shrinkable along the diametrical direction and snacked into the second through hole 62 of the corresponding anchoring plate 6, and the position recess 521 interlocks with the second through hole 62, therefore the latching member 5 engages with the anchoring plate 6 reliably. The cable assembly 100 is securely fastened to the panel 300.

Figure 9:
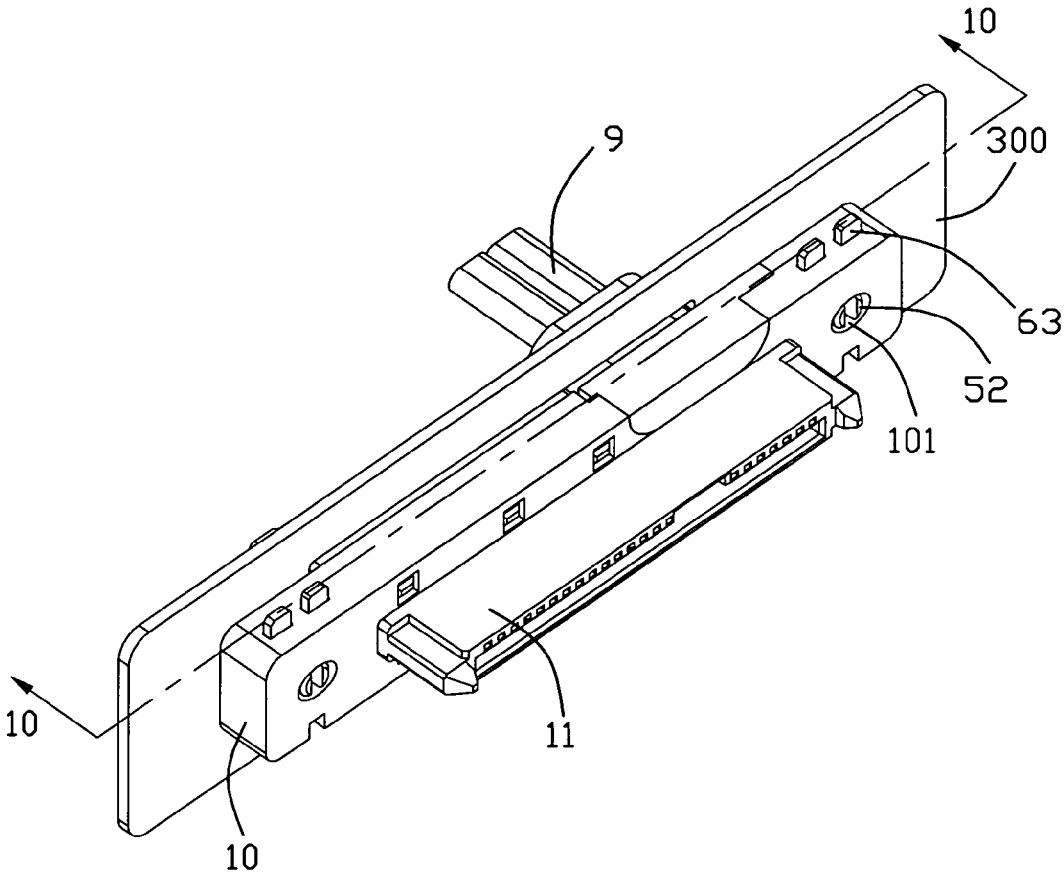
FIG. 9 is an assembled perspective view showing the cable assembly mounted to the panel, with the fastening member under unlocked status.
Figure 10:
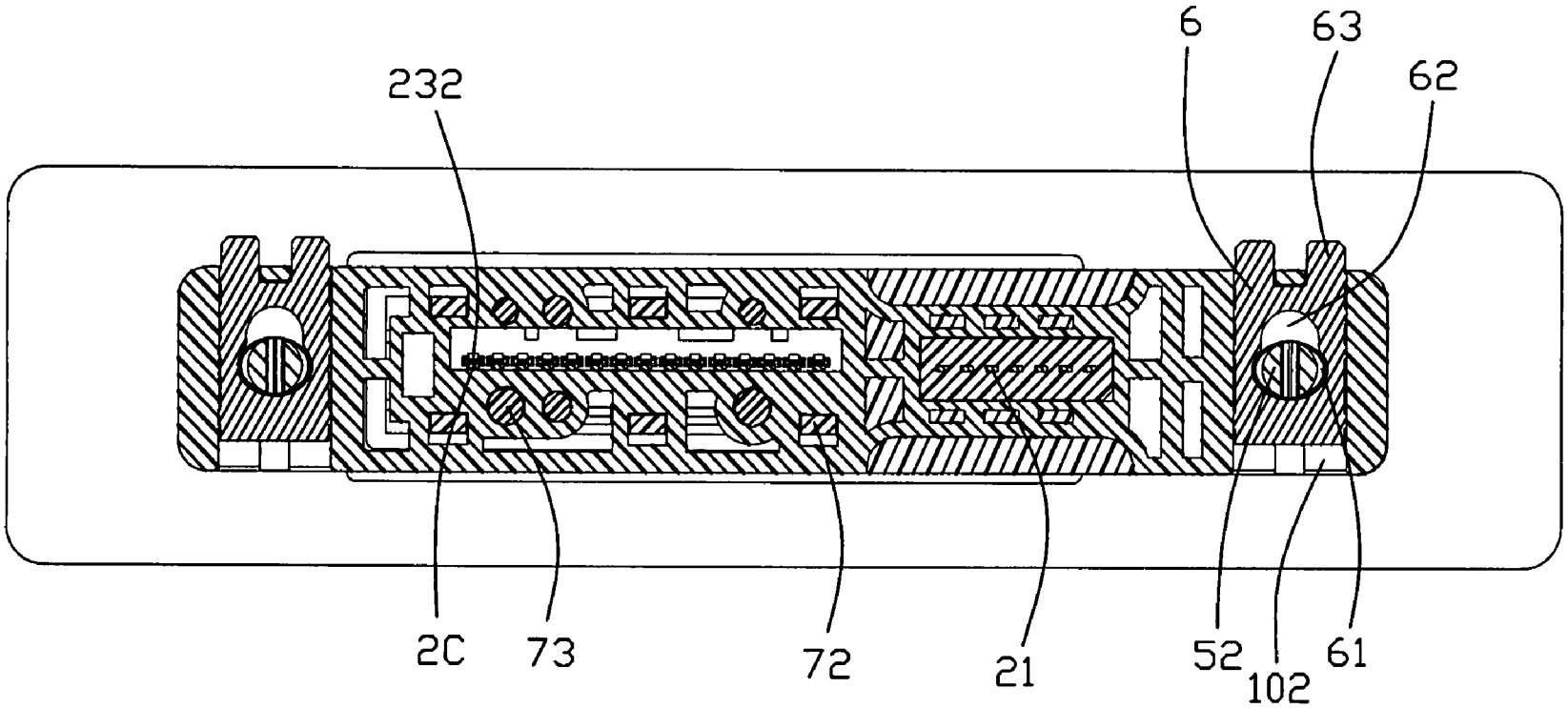
FIG. 10 is a cross-sectional view taken along line 10-10 of FIG. 9.

Referring to FIGS. 9-10, when the cable assembly 100 is demounted away the panel 300, just push the anchoring plate 6 to move it upwardly, with the stubs 63 thereof through the windows 103 of the base portion 10, and the post portion 52 is disposed in the first through hole 61 of the anchoring plate 6. The latching member 5 are pulled out of the mounting slots 101 to separate the panel 300 and the cable assembly 100.

It can be understood that the cable assembly 100 is formed by integrating a cable connector with a power adaptor, wherein the cable connector comprises the first terminals 21 received in the first mating port 11*a* of the first insulated housing 1 and the cable 3 electrically connecting with the first terminals 21 for signal transmission, and wherein the power adaptor includes the second terminals 21 received in the second mating port 11*b* of the first insulated housing 1 and electrically connecting with the second terminals 22 received in the second insulated housing 7 for power transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly adapted for mounting to a panel defining at least a hole therein, said cable assembly comprising:

a first insulated housing having a base portion and a mating portion extending forwardly from the base portion, at least a first mounting slot and a corresponding second mounting slot defined in the base portion, said first mounting slot perpendicular to and in communication with the second mounting slot;

a plurality of terminals received in the first insulated housing;

a fastening member mounted to the base portion of the first insulated housing for fastening the first insulated housing to the panel, the fastening member including a latching member accommodated in the first mounting slot and an anchoring plate accommodated in the second mounting slot, the latching member having a base portion and a shrinkable post portion integrated with the base portion, the anchoring plate defining a first through hole and a second through hole communicated with the first through hole, the post portion being larger than the second through hole and smaller than the first through hole; and the post portion of the latching member inserted into the first mounting hole and locked into the second through hole of the anchoring plate, and the anchoring plate being moveable to align the post portion of the latching member with the first through hole of the anchoring plate to release the latching member from the anchoring plate.

2. The cable assembly as claimed in claim 1, wherein the post portion of the latching member is divided into two deformable parts.

3. The cable assembly as claimed in claim 1, wherein a platform is formed on a peripheral side of the post portion.

4. The cable assembly as claimed in claim 3, wherein a position recess is defined in the platform for locking with the second through hole of the anchoring plate.

5. The cable assembly as claimed in claim 3, wherein the platform further defines a tapered front end thereof.

6. The cable assembly as claimed in claim 1, wherein the panel is disposed behind the base portion of the first insulated housing, and latching member is inserted into the first mounting slot of the first insulated housing via the hole in the panel.

7. The cable assembly as claimed in claim 1, wherein at least a stub extends upwardly from the screw cap.

8. The cable assembly as claimed in claim 7, wherein a window is defined in an upper side of the base portion and in communication with the second mounting slot, the stub is projected outwardly via the window.

9. The cable assembly as claimed in claim 8, wherein a horizontal slot is defined in a lower side of the base section and intersects with the second mounting slot.

10. The cable assembly as claimed in claim 1, further comprising a second insulated housing combined with the first insulated housing, the second insulated housing having a body portion arranged adjacent to the base portion of the first insulated housing, and a mating portion extending rearwardly from the base portion thereof.

11. The cable assembly as claimed in claim 10, wherein the mating portions of the first and second insulated housings are disposed at opposite sides of the panel.

12. The cable assembly as claimed in claim 10, wherein the terminals includes first terminals and third terminals respectively received in the first and second insulated housings, and tail portions of the first terminals contact the tail portions of the third terminals.

13. A cable connector assembly comprising:

an electrical connector having an insulative housing defining a mating portion with a mating port therein;

a plurality of terminals disposed in the housing with contacting sections extending into the mating port;

at least one mounting hole located by a side of the mating portion and extending in a front-to-back direction;

a metallic panel positioned behind the connector and defining at least a through hole located by said side of the mating portion and in alignment with the corresponding mounting hole in said front-to-back direction;

a plurality of cables connected to the corresponding terminals, respectively, and behind the panel;

at least one fastening member including a latch members and a corresponding respective anchoring device operated with each other;

said latch member including at least a post inserted into the corresponding through hole and the corresponding mounting hole in an assembling direction;

each of said anchoring devices being movable between first and second positions, wherein when the anchoring device is located in the first position, the anchoring device is engaged the corresponding latch member so as not to allow said corresponding latch member to be withdrawn from the connector in a withdrawal direction opposite to said assembling direction; when the anchoring device is located in a second position, the anchoring device is disengaged from the corresponding latch member so as to allow said corresponding latch member to be withdrawn from the connector, thus resulting in disassembling the connector from the panel.

14. The cable connector assembly as claimed in claim 13, wherein said anchoring device is moved between said first position and said second position in a transverse direction perpendicular to said front-to-back direction.

15. The cable connector assembly as claimed in claim 14, wherein said anchoring device defines a small through hole and a large through hole communicating with each other and respectively aligned with the mounting hole in said front-to-back direction when said anchoring device is located in said first position and said second position, respectively.

16. The cable connector assembly as claimed in claim 14, wherein said housing defines a mounting slot extending in said transverse direction and communicating with the mounting hole.

17. The cable connector assembly as claimed in claim 13, wherein said withdrawal direction is same with said front-to-back direction.

18. The cable connector assembly as claimed in claim 13, wherein said latch member includes a base, from which said post extends, abutting against the panel for holding said connector and said panel together when said anchoring device is located in the first position.

19. The cable connector assembly as claimed in claim 13, wherein said mounting hole is of a through type while a tip of said latch member is protectively hidden behind a front exterior face of the housing.

20. The cable connector assembly as claimed in claim 13, wherein said post is shrinkable during assembling.

* * * * *